US010254085B2

(12) United States Patent
Willmann et al.

(10) Patent No.: US 10,254,085 B2
(45) Date of Patent: Apr. 9, 2019

(54) DEVICE FOR ARRANGING AN ACCESSORY ON A FIREARM

(71) Applicant: Matthias Willmann, Emsdetten (DE)

(72) Inventors: Matthias Willmann, Emsdetten (DE); Oliver Fischer, Hard (AT)

(73) Assignee: Matthias Willmann, Emsdetten (DE)

( * ) Notice: Subject to any disclaimer, the term of this patent is extended or adjusted under 35 U.S.C. 154(b) by 0 days.

(21) Appl. No.: 15/681,028

(22) Filed: Aug. 18, 2017

(65) Prior Publication Data

US 2017/0370679 A1 Dec. 28, 2017

Related U.S. Application Data

(63) Continuation of application No. PCT/EP2015/080313, filed on Dec. 17, 2015.

(30) Foreign Application Priority Data

Feb. 20, 2015 (DE) ..... 10 2015 102 477

(51) Int. Cl.
*F41G 11/00* (2006.01)
*F41A 21/32* (2006.01)
(Continued)

(52) U.S. Cl.
CPC ..... *F41G 11/003* (2013.01); *F41A 21/325* (2013.01); *F41G 1/35* (2013.01); *F41G 1/36* (2013.01); *F41G 11/004* (2013.01)

(58) Field of Classification Search
CPC .... F41G 11/003; F41G 11/004; F41G 11/001; F41G 1/35; F41G 1/34; F41G 1/36; F41A 21/325; F41A 21/34
(Continued)

(56) References Cited

U.S. PATENT DOCUMENTS 5,351,429 A * 10/1994 Ford ..... F41G 1/35 362/110
5,425,299 A * 6/1995 Teetzel ..... F41A 9/62 42/1.02
(Continued)

FOREIGN PATENT DOCUMENTS

DE 10 2013 107 115 A1 8/2014
DE 102013107115 A1 8/2014
(Continued)

OTHER PUBLICATIONS

German Summons to Hearing, dated Jan. 10, 2018, for corresponding International Application 10 2015 102 477.2 with an English translation.
(Continued)

*Primary Examiner* — John Cooper
(74) *Attorney, Agent, or Firm* — Myers Wolin, LLC

(57) ABSTRACT

A device for arranging an accessory on a firearm, in particular a handgun, is provided, wherein the device has a housing for receiving the accessory in the housing, wherein the housing can be fastened to the firearm, wherein the housing has a first portion with a front end wall and with a rear end wall at a distance from the front end wall, the housing has a second portion, which protrudes axially at the rear end wall of the first portion, the second portion has a fastening device for fastening the housing to the firearm, and the housing has a substantially L-shaped basic form. A firearm with a device for arranging an accessory on a firearm that is arranged on it or can be arranged on it is also provided.

17 Claims, 7 Drawing Sheets

(51) Int. Cl.
*F41G 1/35* (2006.01)
*F41G 1/36* (2006.01)

(58) Field of Classification Search
USPC ..... 42/114–117, 90, 123, 124, 131, 132
See application file for complete search history.

(56) References Cited

U.S. PATENT DOCUMENTS 5,671,559 A * 9/1997 Ludaesher ..... F41B 9/00 222/79
5,685,105 A * 11/1997 Teetzel ..... F41A 9/62 362/114
5,758,448 A * 6/1998 Thummel ..... F41G 1/36 362/114
7,194,836 B1 * 3/2007 Urban ..... F41C 27/22 42/106
7,578,090 B1 * 8/2009 Romaszka ..... F41C 27/16 42/85
7,726,061 B1 6/2010 Thummel
7,937,880 B1 5/2011 Fidlow
D687,508 S * 8/2013 Peterman ..... D22/108
8,662,694 B1 3/2014 Izumi et al.
9,488,439 B2 * 11/2016 Galli ..... F41G 11/003
9,772,163 B2 * 9/2017 Sharrah ..... F41G 11/004
9,810,500 B2 * 11/2017 Murphy, II ..... F41A 17/06
2002/0100202 A1 8/2002 Lin et al.
2006/0026886 A1 * 2/2006 Doukas ..... F41G 1/35 42/117
2008/0040965 A1 * 2/2008 Solinsky ..... F41G 1/345 42/90
2008/0120891 A1 * 5/2008 Wei ..... F41G 11/003 42/90
2009/0064558 A1 * 3/2009 Woroner ..... F41G 11/003 42/90
2010/0031552 A1 * 2/2010 Houde-Walter ..... F41A 35/00 42/72
2011/0035984 A1 * 2/2011 Liu ..... F41C 27/00 42/111
2011/0167704 A1 * 7/2011 Chupp ..... F41C 27/00 42/90
2012/0124885 A1 * 5/2012 Caulk ..... F41G 1/35 42/146
2012/0180366 A1 7/2012 Jaroh et al.
2013/0074351 A1 3/2013 Kowalczyk et al.
2013/0145670 A1 * 6/2013 Kuhlman ..... F41A 19/59 42/84
2014/0092588 A1 * 4/2014 Toman ..... F41G 11/003 362/110
2015/0159847 A1 * 6/2015 Galli ..... F21V 23/0414 362/111
2015/0276347 A1 * 10/2015 Sharrah ..... F41G 1/35 42/117
2015/0362276 A1 * 12/2015 Fischer ..... F41G 11/003 89/14.4
2016/0209149 A1 * 7/2016 Fischer ..... F41C 33/02
2016/0209167 A1 * 7/2016 Wells ..... F41C 27/00
2018/0038580 A1 * 2/2018 Galli ..... F21V 23/0414

FOREIGN PATENT DOCUMENTS

KR 10-2014-0094220 A 7/2014
WO WO-2017102012 A1 * 6/2017 ..... F41A 21/325

OTHER PUBLICATIONS

International Search Report issued for corresponding International Patent Application No. PCT/EP2015/080313 dated Feb. 4, 2016.
German Office Action issued for corresponding German Patent Application No. 10 2015 102 477.2 dated Aug. 6, 2015 with an English translation.
International Preliminary Report on Patentability, dated Aug. 22, 2017, for corresponding International Application No. PCT/EP2015/080313 with English translation.

* cited by examiner

DEVICE FOR ARRANGING AN ACCESSORY ON A FIREARM

CROSS REFERENCE TO RELATED APPLICATIONS

This application is a continuation of International Application No. PCT/EP2015/080313, filed on Dec. 17, 2015, which claims priority to German Application No. 10 2015 102 477.2, filed Feb. 20, 2015, the contents of each of which are incorporated by reference herein.

TECHNICAL FIELD

The invention relates to devices for arranging accessories on a firearm, in particular, a handgun.

BACKGROUND

The term "handgun" relates to pistols, e.g., blowback operated weapons, or gas operated weapons, guns, and the like. The invention will be described by means of the example of a handgun, although the present invention is not limited to the latter and might be implemented in long guns just as well.

It is known to equip firearms with accessories or to attach accessories to firearms. For example, it is known to arrange a tactical light, a laser sight, or a camera on the firearm, for example, a pistol.

A merchantable pistol with a tactical light arranged thereon is shown in FIG. 1. A pistol with a camera arranged thereon is known, for example, from US 2011/0035984 A1. With respect to the pistol shown in FIG. 1, the tactical light 50 is arranged at the underside of the barrel 5 of the pistol. In the following, "barrel" is intended to designate the entire front portion of the gun, namely, the actual gun barrel forming the barrel bore together with the breechblock and the front portion of the grip piece of the weapon. Instead of the tactical light shown in FIG. 1, also a laser sight may be arranged at the underside of the barrel 5.

Such systems known from prior art, however, are disadvantageous in that only one accessory means can be arranged at the underside of the barrel. For example, only the tactical light or only the laser sight may be arranged there. In order to fix other accessory means to the underside of the barrel, at first, the accessory means already attached there has to be removed.

Moreover, there is the additional disadvantage with respect to the attachment of a laser sight that the optical central axis of the laser sight is relatively remote from the bore axis of the barrel bore. This large distance between the two axes has a negative impact on the target accuracy at different firing ranges. Therefore, it is provided for configuring the optical center axis of a laser sight adjustably in order to be able to set the angle between the optical center axis of a laser sight and the bore axis of the barrel bore depending on the distance to the targeted object, as described, for example, in US 2012/0180366 A1.

A further disadvantage is that a close-contact shot mostly is not possible because the tactical light or laser sight arranged at the weapon in many cases protrudes beyond the front end of the barrel, as can be seen, for example, in FIG. 1.

For a camera arranged at the underside of the bearable, as shown in US 2011/0035984 A1, the angle between the optical axis of the camera and the axis of the barrel bore is irrelevant. Here, it is only important that the camera is directed to the front.

From U.S. Pat. No. 7,726,061 B1, also, a firearm with a tactical light arranged thereon is known. The tactical light is accommodated within a housing fixed to the underside of the barrel. Further, a laser arrangement is accommodated within the housing. The entire housing is arranged below the barrel such that the tactical light as well as the laser arrangement is disposed completely below the barrel.

From US 2012/0180366 A1, a camera laser system is known, which is accommodated within a housing, wherein the housing may be fixed to the barrel of a weapon. The camera and the laser, hereby, are disposed above the barrel such that the shooter is able to aim at the target by means of the laser. However, here, the distance between the camera and the barrel always has to be taken into account in order to be able to correctly adjust the laser, because the camera and the laser are relatively remote from the center axis of the barrel.

From U.S. Pat. No. 7,578,090 B1, a so-called "strike plate" is known, which may be attached to the weapon. The "strike plate" should ensure that the barrel and/or the slide of a weapon return into the starting position, in which the weapon is ready for use for the next shot again after firing a bullet. The "strike plate" is fixed to the mounting rail of the weapon and extends beyond the barrel of the weapon, wherein a concentric hole is provided in the portion in front of the barrel through which the fired bullet may pass. At the underside of the "strike plate", there is provided a further mounting rail, on which further accessories may be arranged.

From US 2012/0124885 A1, a light system is known, which is fixable to the underside of the barrel of a weapon. It substantially corresponds to the systems known from U.S. Pat. No. 7,726,061 B1. Also here, the optical axis of the light system is relatively remote from the center axis of the barrel bore such that, when using a laser sight in the light system, the angle of the laser also has to be set depending on the distance to the object.

A system similar to the system known from U.S. Pat. No. 7,726,061 B1 is known from US 2008/0120891 A1. Here, the system, which may comprise a laser light is attached to the underside of the barrel, wherein the optical axis of the laser light is disposed below the mounting rail of the barrel. The large distance between the center axis of the barrel bore and the optical axis of the laser light resulting from this also here requires that the angle of the laser light has to be set, if needed.

SUMMARY

Therefore, it is an object of the present disclosure to provide a device for arranging accessories on a firearm, which at least partially avoid the disadvantages known from the prior art mentioned above, and which, on the one hand, allows for fixing different accessory means on the weapon at the same time, and, on the other hand, ensures an improved accuracy at different firing ranges.

This object is solved by a device for arranging accessories on a firearm according to the independent claim. Preferred embodiments and further developments of the device are specified in the dependent claims.

Accordingly, a device for arranging accessories on a firearm, in particular, a handgun is provided, wherein the device comprises a housing for receiving the accessories within the housing, wherein the housing can be fastened to the firearm, wherein the housing substantially has an L-shaped basic shape, the housing has a first portion with a front end wall and with a rear end wall spaced apart from the front end wall, the housing has a second portion, which axially protrudes at the rear end wall of the first portion, one leg of the L-shaped basic shape is formed by the first portion and the other leg of the L-shaped basic shape is formed by the second portion, wherein the two portions are arranged substantially perpendicular to each other, and wherein the rear end wall of the first portion is substantially perpendicular to the top side of the second portion, and the second portion comprises a fastening device for fastening the housing to the firearm.

Because the second portion protrudes axially at the rear end wall of the first portion, the device may be fixed to the weapon with the second portion such that the first portion is moved to the bore axis of the weapon from below. Thereby, also a laser sight received within the housing may be brought closer to the bore axis of the weapon. Thereby, a higher accuracy of the laser sight is ensured at different firing ranges. In particular, it is no longer necessary to set the angle between the optical axis of the laser sight and the bore axis of the weapon, because by moving the laser sight to the bore axis, both axes are lying that close to each other such that deviations with respect to the accuracy resulting from this are negligible.

It is advantageous, if the second portion of the housing runs parallel to a longitudinal axis of the housing, and the fastening device comprises two fastening rails, which are formed at the top side of the second portion, and which are spaced apart from each other and run parallel to the longitudinal axis of the housing, wherein the inner profile formed by the fastening rail and the top side of the second portion extending between the two fastening rails substantially corresponds to an outer profile of a mounting rail of the firearm, so as to be able to bring the second portion into engagement with the mounting rail in order to fix the housing at the firearm, preferably, releasably.

Advantageously, the inner profile corresponds to the outer profile of a mounting rail provided at the underside of the barrel of the firearm.

According to a preferred embodiment of the device the rear end wall of the first portion is arranged substantially perpendicular to the top side of the second portion, and/or the height of the part of the first portion protruding beyond the top side of the second portion is selected such that this protruding part, in a fixed state of the housing, is arranged on the firearm at least partially axially in front of the barrel of the firearm, and protrudes at least partially into an imaginary extension of the barrel.

Thereby, the first portion of the housing may be brought even closer to the bore axis of the barrel such that also the distance between the bore axis and the optical axis of a laser sight may be reduced even further, and thereby, the accuracy of the laser sight may be increased even further for different firing ranges.

It is advantageous, if the accessory comprises a light emitting source, in particular, a laser light emitting diode being arranged within the housing, wherein the front end wall of the first portion has a first opening in the area of the protruding part of the first portion, through which a light beam, in particular, a laser light beam of the light emitting source may exit from the housing. Hereby, it is advantageous, if the light emitting source is also arranged in the first portion of the housing. The light emitting source, however, may also be arranged in the second portion of the housing, wherein the light beam is deflected, for example, via a mirror means, to the first opening.

It is preferable, if the position of the first opening in the front end wall is selected such that the distance between the center of the first opening and the bore axis of the barrel is at minimum, preferably, smaller than 15 mm, particularly preferable smaller than 12 mm, more particular preferably smaller than 9 mm.

According to a further embodiment of the device, a shot channel may be formed in the first portion of the housing, which extends concentrically with respect to the barrel bore of the barrel, wherein the first opening is arranged below the shot channel.

Thereby, also with accessories being arranged on the firearm, a close-contact shot is possible.

According to an embodiment of the device, the accessory may comprise a tactical light, wherein the light source for the tactical light is arranged within the housing, and wherein the front end wall of the first portion has a second opening through which the light of the light source for the tactical light may exit from the housing, and/or comprise an imaging means, in particular, a video camera or a webcam, wherein the imaging means is arranged within the housing, and wherein the front end wall of the first portion has a third opening, through which light from outside may reach the optics of the imaging means, and/or comprise a communications interface, in particular, a wireless communications interface being adapted to establish a communications connection to a mobile terminal, in particular, a smart phone, and/or to a mobile network, and/or comprise a recording means, and/or comprise means for determining the geographical position of the device, in particular, a GPS module, wherein an energy storage, preferably an accumulator, is arranged within the housing, preferably, in the second portion of the housing, which is coupled electrically to the accessory in order to supply electrical energy to the accessory.

By arranging the accumulators in the second portion of the housing, that means, in the portion of the housing which, in a mounted state, is arranged below the gun barrel, an improved weight distribution is achieved.

According to an embodiment of the device, the energy storage may be wireless, preferably, chargeable inductively, and/or a connector may be provided at the housing in order to charge the energy storage by wire.

According to a preferred embodiment of the device, means may be provided in or at the housing for automatically activating the accessories arranged within the housing, wherein the means for automatic activation comprises a switching means cooperating with a holster of the firearm such that upon pulling the firearm from the holster, the switching means can be activated, wherein the accessory is activated by the activated switching means, and/or a position sensor being adapted to activate and/or deactivate the accessory depending on the position and/or orientation of the housing.

It is particularly advantageous, if the first portion and the second portion of the housing or the housing are formed in one piece, thus, the first portion and the second portion form a one-piece housing.

Moreover, it is advantageous, if a locking means is provided at the second portion of the housing in order to lock the housing to the weapon after the attachment.

The locking means may comprise at least a locking pin or a locking rocker. The locking means is supported pivotably about a pivot axis. A spring member is assigned to the locking pin or the locking rocker, wherein spring force brings the locking rocker into a locking position or retains it in the locking position. The locking pin or the locking rocker may be brought into a release position against the spring force, in which the housing may be detached from the mounting rail of the firearm.

According to an embodiment of the device, the locking rocker may be aligned substantially in parallel to the longitudinal axis of the housing, and, in a mounted state of the device on the weapon, may be brought into engagement with the trigger of the weapon in order to lock the device on the weapon.

According to a further embodiment of the device, a mounting rail may be provided at the underside of the housing in order to attach even further accessories to the housing. At the underside of the housing or at the mounting rail arranged at the underside of the housing, an electrical contact may be provided, which is coupled electrically to the accumulator arranged within the housing. Thereby, a further accessory arranged at the mounting rail of the housing may be supplied with electrical energy from the accumulators arranged within the housing.

It is particularly advantageous, if the outer contour of the first portion of the housing is adapted to the outer contour of the barrel of the weapon. Thereby, the rear side, the front side, and the edge sight of the weapon may be further used, even with a housing mounted.

The front end wall may be formed by a cover plate or by a trough-shaped cover. According to an embodiment of the device, this cover may be arranged on the housing releasably. The openings mentioned above may be formed in this cover.

The cover plate or cover trough is made at least partially from a particularly hard material, as from hardened steel or from ceramics. Thereby, the housing, in a mounted state, may be used as hitting means, for example, for smashing glass, in particular, vehicle window panes.

A mandrel, which may be configured arbitrarily, may be arranged at the front end wall or at the cover plate. According to an embodiment of the device, the mandrels and the cover plate may be formed from one piece. It is advantageous, if the mandrels also are made from a particularly hard material, as from hardened steel or from ceramics. Preferably, the mandrels converge in axial direction at an acute angle.

According to an embodiment of the device, the mandrels may be arranged at the front end wall or at the cover plate releasably. According to an alternative embodiment, the mandrels may be arranged at the front end wall or at the cover plate pivotably such that they may be folded away when not in use.

Further, a firearm is provided, in particular, a handgun comprising a device for arranging accessories on the firearm.

Further, a holster for holstering a firearm, in particular, a handgun, is provided, wherein the holster is adapted to holster a firearm with a device for arranging accessories on the firearm attached thereto, and being adapted to cooperate with a switching means provided on the device such that upon pulling the firearm from the holster, the switching means is activated.

BRIEF DESCRIPTION OF THE DRAWINGS

Details and features of the invention can be derived from the following description in connection with the drawing, in which.

DETAILED DESCRIPTION

The device for arranging an accessory on a firearm described below has the advantage that several accessories can be fixed to the weapon at the same time. A further advantage is that the inventive configuration of the housing of the device and the inventive arrangement of the laser sight within the housing of the device substantially improves the accuracy of the laser sight at different firing ranges. A further advantage is that the device may be fixed or mounted and dismounted in a particularly simple, secure and fast manner. Further, additional application areas of the firearm are opened by the device and the weapon can be used for different application scenarios, respectively, without having to replace the accessory means for this.

Figure 1:
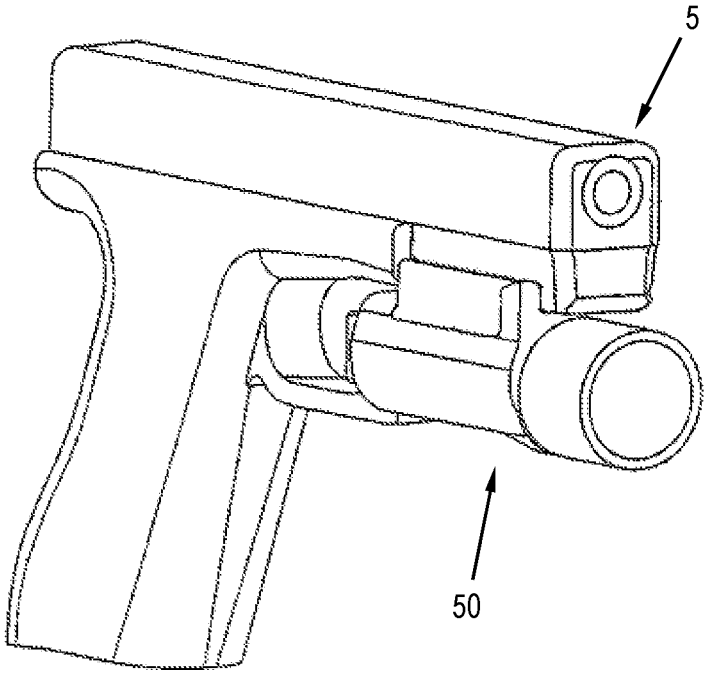
Fig. 1 Prior Art
FIG. 1 shows a handgun with a tactical light arranged thereon according to prior art.
Figure 2:
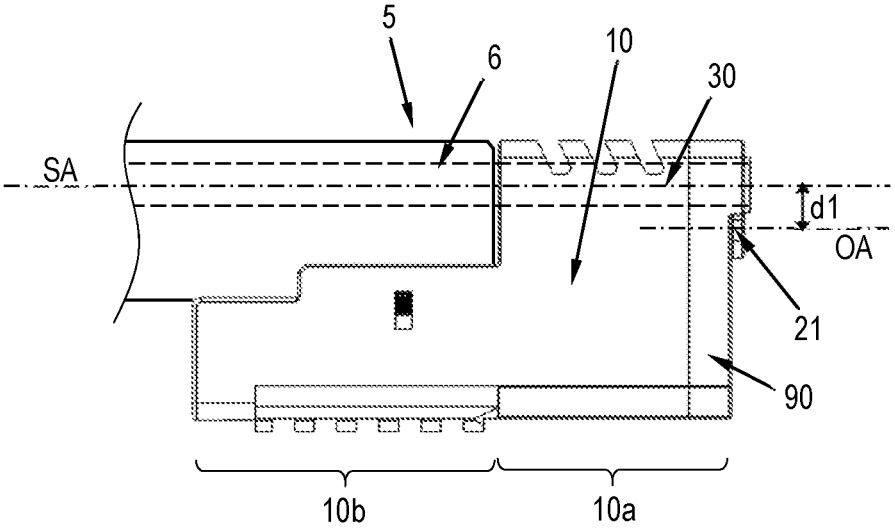
FIG. 2 shows the front end of a handgun with a device according to the disclosure arranged thereon.

FIG. 2 shows a device for arranging an accessory on a firearm which is fixed to a barrel of the firearm. In FIG. 2, only the front portion of the barrel 5 of the weapon is shown, wherein here, the term "barrel" means the barrel forming the barrel bore 6 as well as the breechblock and the front portion of the grip piece.

The device comprises a housing 10 having a first portion 10*a* and a second portion 10*b*. The housing has a substantially L-shaped basic shape, wherein one leg of the L-shaped basic shape is formed by the first portion 10*a*, and the other leg by the second portion 10*be* of the housing. Both portions 10*a*, 10*b*, thereby, are arranged perpendicular with respect to each other, and a substantially right angle is formed by the two sections 10*a*, 10*b*.

The second section 10*b* of the housing 10 comprises fastening means in order to fix the housing to the barrel 5. Preferably, the fastening means are configured such that the housing may be fixed to a mounting rail provided at the underside of the barrel 5. The mounting of the device on the weapon advantageously results from fitting the housing 10 onto the mounting rail of the barrel 5.

By means of the L-shaped configuration of the housing 10, after mounting, the first portion 10*a* of the housing 10 is arranged axially in front of the barrel 5, i.e., the part of the first portion 10*a* protruding upwards at the second portion 10*b* is located axially in front of the barrel 5, and protrudes into an imaginary extension of the barrel. Thereby, a first opening 21, through which the light of a laser sight can exit from the housing 10, also may be provided axially in front of the barrel 5 in the first portion 10*a* of the housing 10 such that the opening 21, after the attachment of the housing 10 to the weapon, is located directly in front of the barrel, while according to the prior art, the outlet opening for the laser sight always is arranged below the barrel. By the inventive configuration of the housing 10 and the inventive arrangement of the first opening 21 in the first portion 10*a* of the housing 10, the distance d1 between the bore axis SA of the barrel bore 6 and the optical center axis OA of the laser sight can be minimized. The optical axis OA of the laser sight, therefore, may be moved close to the bore axis SA of the barrel bore 6.

The distance d1 between the two axes SA, OA, thereby, may be reduced from the conventional 70 mm according to the prior art to approximately 15 mm, preferably, to about 12 mm, particularly preferred to about 8 mm or less. The accuracy of the laser sight thus may be substantially improved at different firing ranges.

As can be seen in FIG. 2, the height of the first portion 10*a* of the housing 10 is selected such that the part of the first portion 10*a* protruding upwards beyond the second portion 10*b* also is arranged axially in front of the muzzle of the weapon, i.e., protrudes into the imaginary extension of the barrel. This is possible, because a shot channel 30 is formed in the first portion 10*a* of the housing 10, which extends coaxially with respect to the barrel bore 6 of the weapon. Here, the shot channel only forms a through hole for the bullet. Thereby, a close-contact shot is also possible with the device being mounted on the weapon without the accessory means accommodated within the housing 10 affecting the shot.

The first portion 10*a* and the second portion 10*b* of the housing 10 are formed as one piece, that means, the two portions 10*a*, 10*b* together form a one-piece housing 10. As far as access to the interior of the housing 10 is desired, for example, for the purpose of inspection and/or maintenance, closable maintenance openings may be provided at the housing 10.

Figure 3:
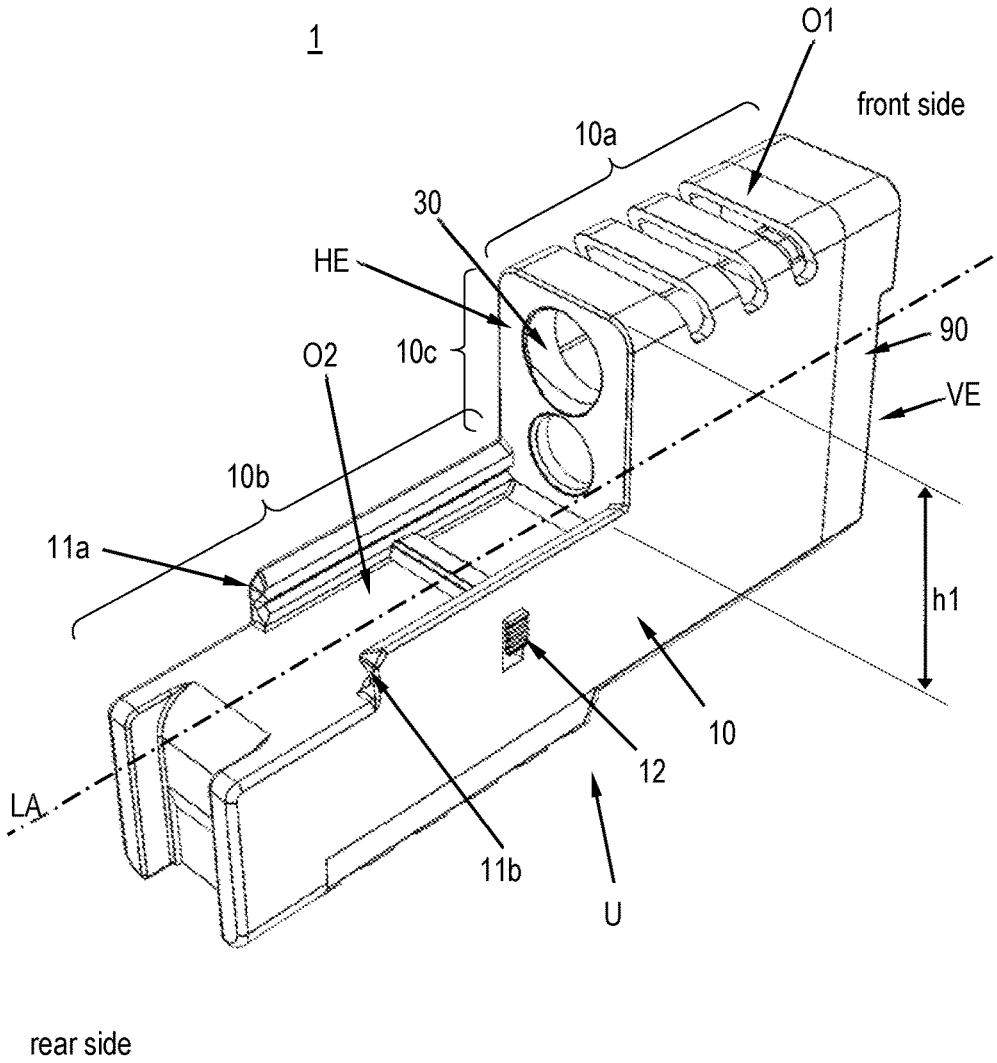
FIG. 3 shows the device for arranging accessories on a firearm in a perspective view.

FIG. 3 shows a device 1 in a perspective view diagonally from above.

Here, the top side O1 of the first section 10*a* and the top side O2 of the second section 10*b* can be seen in detail.

The second portion 10*b* has fastening means at the top side O2, which here are formed as a first fastening rail 11*a* and a second fastening rail 11*b*. The fastening rails 11*a*, 11*b* are configured such that they correspond to an outer profile of a mounting rail of the weapon so that the housing 10 may be pushed onto the mounting rail of the weapon.

The second portion 10*b* of the housing 10 may comprise a locking means 12 by means of which the housing 10 pushed onto the mounting rail of the weapon may be locked on the weapon in order to prevent an inadvertent release of the housing from the weapon. An embodiment of the locking means is described with reference to FIG. 8.

The first section 10*a* of the housing has a front end wall VE and a rear end wall HE, wherein for the embodiment of the inventive device shown here, these two end walls are substantially arranged perpendicular with respect to each other. However, it is also possible to provide the front end wall VE inclined at a certain angle with respect to the rear end wall HE.

The front end wall VE may be formed by a cover plate or by a trough-shaped cover 90. The cover is made from a particularly hard material, as hardened steel or ceramics, and may be used for smashing windows, for example, vehicle window panes.

Additionally, mandrels may be arranged at the front end wall VE or at the cover 90, which may also be made from a particularly hard material. The mandrels may have different or arbitrary shapes. Preferably, they converge in an acute angle in axial direction with respect to the housing.

The second portion 10*b* of the housing 10 is arranged at a right angle with respect to the rear end wall HE of the first portion 10*a* of the housing 10 such that the top side O2 of the second portion 10*b* and the rear end wall HE of the first portion 10*a* substantially are perpendicular with respect to each other. An entrance opening of the shot channel 30 is provided in the rear end wall HE of the first portion 10*a*. At the opposing end wall VE, a corresponding exit opening of the shot channel 30 is provided, wherein the shot channel 30 substantially has the diameter of the barrel bore of the firearm, and extends coaxially with respect to the barrel bore of the firearm.

The height h1 of the part 10*c* of the first portion 10*a* protruding beyond the top side O2 of the second portion 10*b* is selected such that the surface O1 of the first portion 10*a*, in a mounted state of the device 1, substantially extends to the upper edge of the barrel or the breechblock of the weapon. Preferably, the outer contour of the part 10*c* of the first portion 10*a* protruding beyond the top side O2 of the second portion 10*b* is selected such that it corresponds to the outer contour of the barrel or of the breechblock of the weapon. The front sight, the rear sight, and the edge sight of the weapon, thus, may be further used and do not have to be adapted to the contour of the housing.

Figures 4A, 4B, 4C:
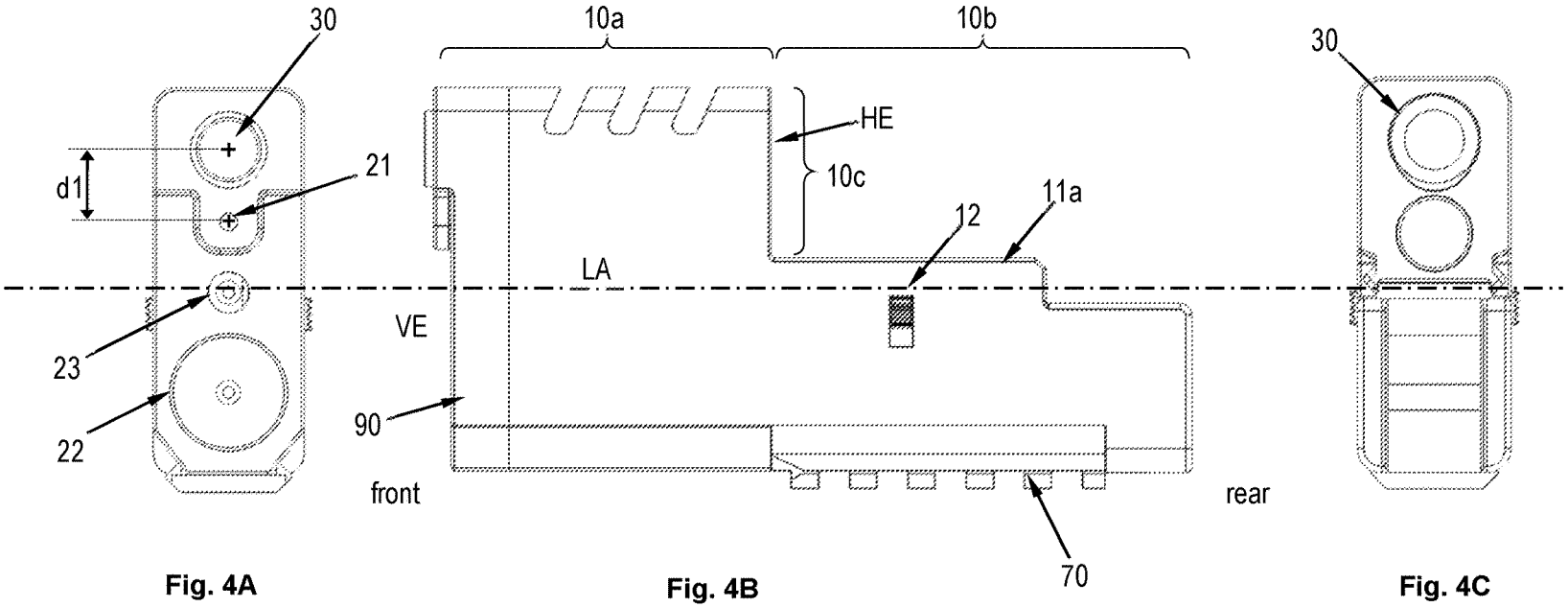
FIGS. 4A-C show the device in a side view, in a front view, and in a rear view.

FIG. 4A shows the device in a front view, FIG. 4B shows the device according in a side view, and FIG. 4C shows the device in a rearview.

Here, further openings 22, 23 provided in the first section 10*a* or at the front end wall VE of the housing 10 can be seen, wherein the second opening 22 is an exit opening for a tactical light, and wherein the third opening 23 is the opening for an imaging means arranged within the housing 10, through which the light may reach the optical elements of the imaging means.

Also, in FIG. 4A the distance d1 between the center of the opening 21 of the laser sight and the bore axis of the barrel is shown. As can be seen in FIG. 4A, the opening 21 for the laser sight may be moved further upwards in order to reduce the distance d1 even further. In particular, it is possible to move the opening 21 that far upwards until the distance between the barrel bore and the opening 21 is approximately zero.

In FIG. 4B, also the substantially L-shaped basic shape of the housing 10 can be seen particularly well.

The locking means 12 and the second portion 10*b* of the housing 10 is configured such that it may be pushed or moved downwards so as to release the locking of the housing on the weapon.

Figure 5:
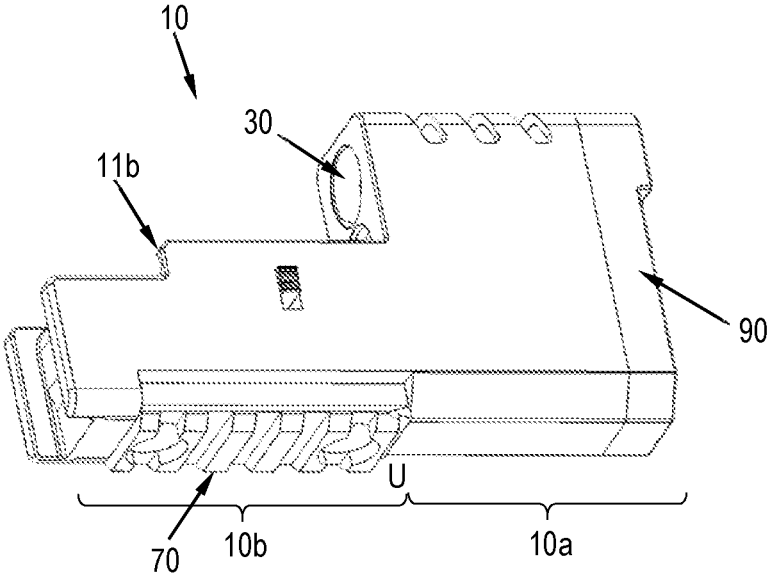
FIG. 5 shows the device in a perspective view of diagonally from the bottom.

FIG. 5 shows the device in a perspective view diagonally from below. In this view, the mounting rail 70 provided at the underside U of the housing 10 can be seen. The mounting rail may be used in order to fix further accessories to the underside U of the housing 10. For example, a video camera may be fixed at the underside of the housing 10, as far as no video camera is provided within the housing 10.

Electrical contacts may be provided at the underside U of the housing 10 or at the mounting rail 70, which are electrically connected to an accumulator accommodated within the housing 10. Via these electrical contacts corresponding to electrical contacts of further accessories attached to the mounting rail 70, electrical components of the further accessories may be supplied with electrical energy such that no own power supply has to be provided in the further electrical accessories, thus, reducing the weight of the further accessories.

Besides the laser sight, a communications interface, in particular, a wireless communications interface may be provided within the housing 10 as further accessories. This communications interface may be adapted to establish a communications connection to a smartphone of the shooter or to a mobile network. Thereby, data transmission between electrical components (accessories) and a portable terminal (for example, a smartphone) may be carried out. By means of this data transmission, also control signals or control commands may be transmitted from a terminal to the accessory means within the housing 10 in order to, for example, control certain accessory means remotely.

The electrical contacts provided at the underside U of the housing 10 or at the mounting rail 70 may also be used for data transmission between an accessory means fixed to the mounting rail 70 and the housing 10. In combination with the communications interface, thus, data provided from the accessory means arranged on the mounting rail 70 may be transmitted to a remote terminal or data, for example, control data, may be transmitted from a remote terminal to this accessory means.

The mounting rail 70 shown in FIG. 5 is provided only at the underside of the second portion 10*b* of the housing 10. Alternatively or additionally, a mounting rail may also be provided at the underside of the first portion 10*a* of the housing 10.

Figure 6:
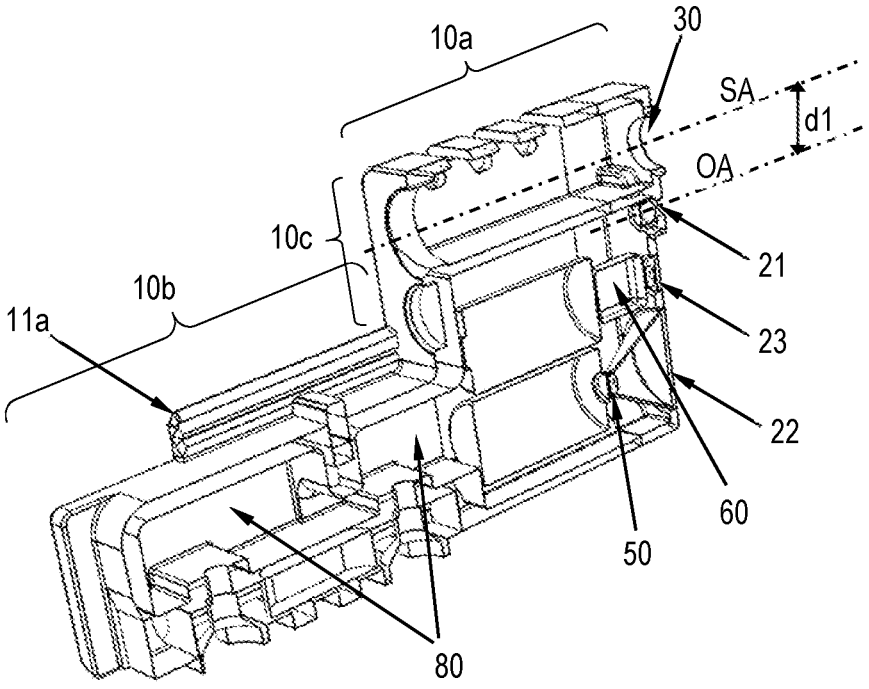
FIG. 6 shows a section of the device in a perspective view.

FIG. 6 shows a longitudinal section of a device in a perspective view.

In the first section 10*a*, an imaging means 60, for example, a video camera or a webcam may be arranged. The imaging means 60 may be coupled to the communications interface mentioned above in order to transmit, for example, live images to a remote terminal. In addition to the imaging means 60, also a recording means may be provided in order to be able to also transmit audio data together with the image data to a remote terminal. Thus, the use of the weapon may be monitored by third parties, critical situations may be analyzed and assessed in real time, and corresponding measures may be taken, if needed. The transmitted image and audio data, moreover, may be recorded for documentation purposes. For recording the image and audio data, a storage means may also be provided within the housing 10, which is advantageous in case no communications connection can be established to an external or remote apparatus.

Further, a tactical light may be provided in the first portion 10*a* of the housing, which may be used for illuminating the shooting area.

The light-emitting laser diode of the laser sight may be arranged directly behind the opening 21. Alternatively, the laser diode may also be arranged at another position within the housing 10, and the light of the laser diode may be deflected, for example, via deflection mirrors, to the opening 21.

Further, means for determining the geographical location of the housing 10 may be provided within the housing 10. Preferably, a GPS module is provided for this. The location data determined by the GPS module may be transmitted to an external terminal together with the image and audio data via the communications interface.

Further, a position or motion sensor may be arranged within the housing 10. The position or motion sensor may be provided in order to activate or to deactivate accessory means arranged within the housing 10. For example, it may be provided for the accessory means only being activated, if the longitudinal axis LA of the housing 10 is inclined with respect to the horizontal within a certain angle range. Thus, for example, the accessory may be de-activated, if the weapon is directed downwards to the ground or to the sky, and the accessory means may be activated, if the weapon is directed substantially horizontally to the front. Thereby, energy for the operation of the accessory means can be saved. According to an embodiment of the invention, it may be provided for only selected accessory means being able to be activated or deactivated by means of the position or motion sensor while the other accessory means have to be activated or deactivated manually.

For activating or deactivating certain or all accessory means, a switching means cooperating with a holster of the firearm not shown here may be provided within the housing 10. The switching means and the holster may be configured such that upon pulling the firearm from the holster, the switching means is activated, this, in turn, activating selected or all accessory means. Upon inserting the firearm into the holster, the switch then is deactivated.

Moreover, an energy supply, in particular, accumulators 80, may be provided within the housing 10, which preferably are arranged in the second portion 10*b* of the housing 10. Thereby, an optimal wage distribution of the device is achieved. Preferably, the energy storage or the accumulators 80 are charged wirelessly, preferably inductively. According to an alternative embodiment, a connector may be provided at the housing in order to be able to charge the energy storage by wires.

Figure 7:
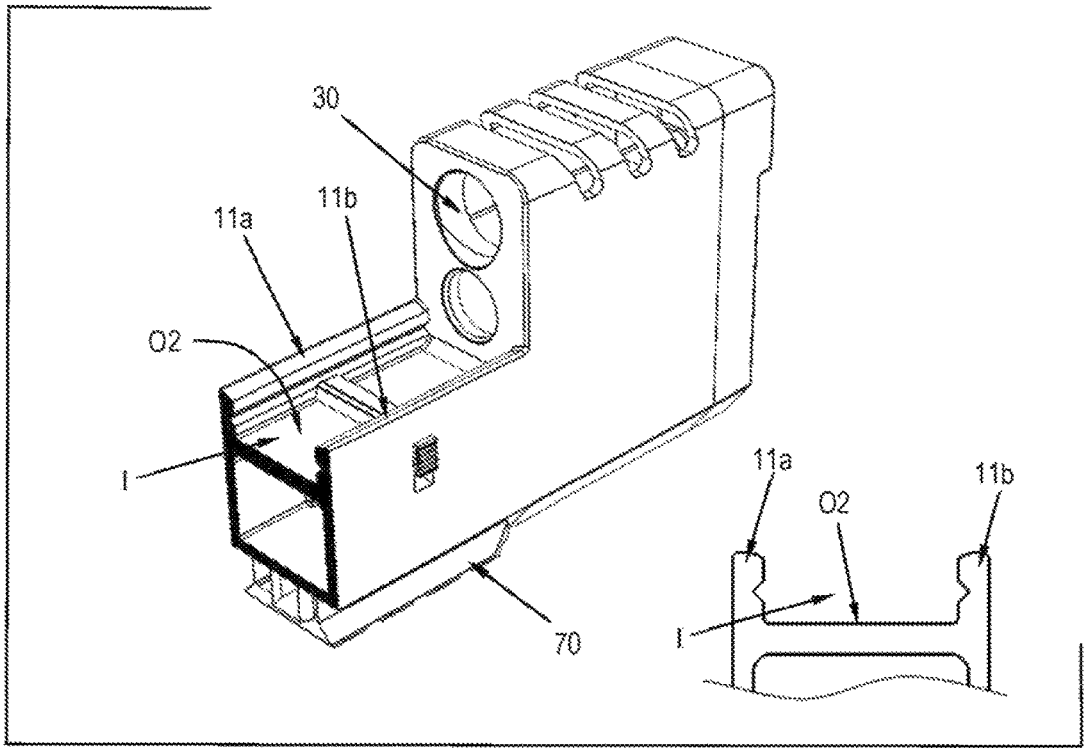
FIG. 7 shows a perspective view of a device according to the disclosure with a detailed view of the profile of the second portion of the housing.

FIG. 7 shows the device according in a perspective view, wherein the second portion 10*b* is shown in cross-section.

The inner profile formed by the first fastening rail 11*a*, by the second fastening rail 11*b*, and by the top side O2 of the second portion 10*b* of the housing 10 extending between the two fastening rails 11*a*, 11*b* is formed substantially U-shaped, and is adapted to the outer profile of the mounting rail of the firearm. The two fastening rails 11*a*, 11*b* comprise recesses or grooves extending in longitudinal direction, by means of which the projections provided at the mounting rail of the weapon may be brought into engagement. The housing 10 may thus be fitted onto the mounting rail of the weapon from the front, and may be locked by means of the locking means 12 on the weapon, if needed.

Figure 8:
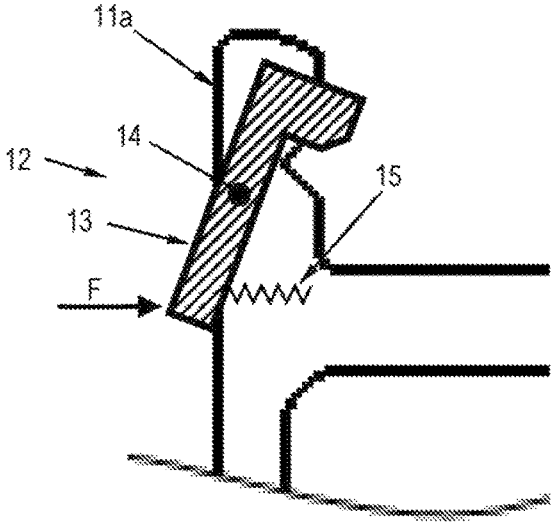
FIG. 8 shows an embodiment of the locking means.

FIG. 8 shows an embodiment of a locking means in cross-section. The locking means, here, comprise a locking pin or a locking rocker 13, which here is provided at the first fastening rail 11*a*. A further locking pin or a further locking rocker 13 may be provided at the second fastening rail 11*b*. Several locking pins or locking rockers 13 may be provided at the two fastening rails 11*a*, 11*b*, respectively. The locking rocker 13 is supported pivotably about a pivot axis or rotation axis 14. Moreover, a spring member 15 is assigned to the locking pin or the locking rocker 13, wherein the spring force brings the locking rocker 13 into a locking position or retains it in the locking position. The locking pin or the locking rocker may be brought into a release position against the spring force (by pushing, as illustrated by the compressive force F), in which the housing may be drawn from the mounting rail of the firearm.

In the locking position, an end of the rocker 13 protrudes from the inner side wall of the fastening rail 11*a* and engages with a recess at the mounting rail of the firearm. The recess may be formed by gaps formed by bars spaced apart from and parallel to each other extending obliquely with respect to the mounting rail.

In FIG. 8, the rocker 13 is aligned perpendicular with respect to the longitudinal axis LA of the housing 10. Alternatively, the rocker 13 may also be aligned in parallel to the longitudinal axis of the housing 10, as shown in FIG. 9.

Figure 9A:
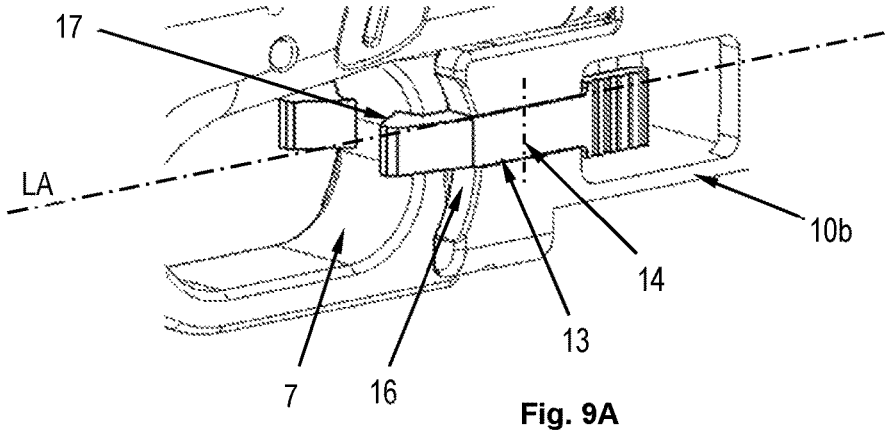
FIGS. 9A-C show an alternative embodiment of a locking means.
Figure 9B:
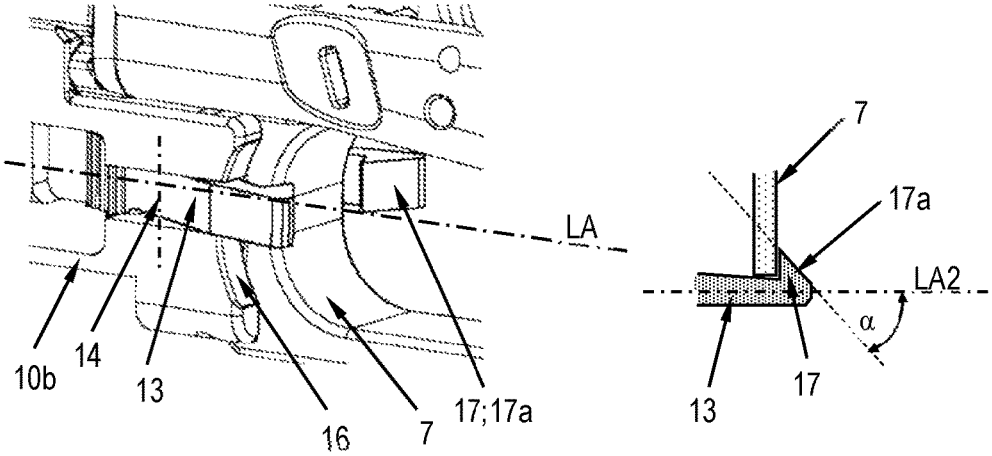
Figure 9C:
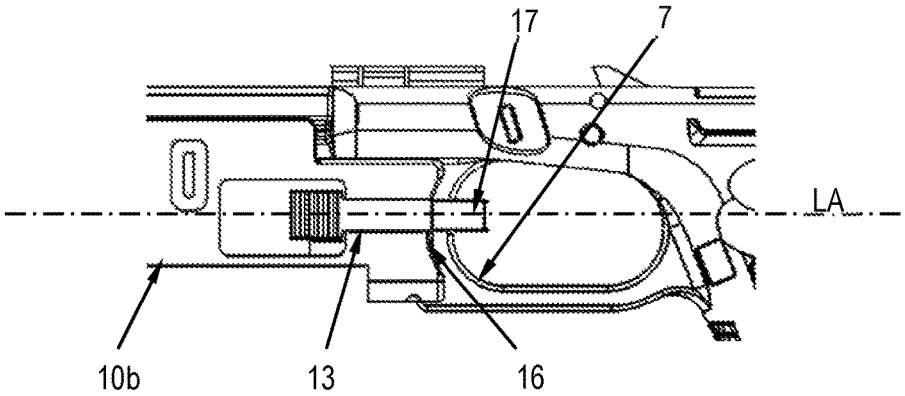

FIGS. 9A-C show an alternative embodiment of a locking means 12 of a device 1, which is arranged at or fastened to the weapon, wherein in FIG. 9A, the locking means is in a locking position, in FIG. 9B the locking means is in a release position, and in FIG. 9C, the locking means is shown in a side view.

The locking means 12, here, consists of at least one locking rocker 13, which is arranged substantially parallel to the longitudinal axis LA of the housing 10. The locking rocker 13, here, is also supported pivotably about a pivot axis 14 at the housing 10, i.e., at the second portion 10*b* of the housing 10 such that the locking rocker 13 can be brought from a locking position (as shown in FIG. 9A) into a release position (as shown in FIG. 9B). In the release position, the device 1 can be detached from the weapon.

The locking rocker 13 is arranged at the rear end 16 of the housing portion 10*b*, and namely such that a portion of the locking rocker 13 protrudes beyond the rear end 16 of the housing portion 10*b*. By means of the portion protruding beyond the rear end 16 of the housing portion 10*b*, the device 1 is locked at the weapon by being able to bring this portion into engagement with the trigger 7 of the weapon. At the portion protruding beyond the rear end 16 of the housing portion 10*b*, a pin 17 is provided, which, in the locking state, engages with the trigger 7, and thus prevents an autonomous or inadvertent releasing of the device 1 from the weapon.

The side of the pin 17 facing the trigger 7 comprises a surface 17*a* slanting downwards inwardly. That means the angle α included by the surface 17*a* and the longitudinal axis LA2 of the locking rocker 13 is smaller than 90°, preferably smaller than 75°, particularly preferred about 40°. Thereby, the slanted surface 17*a*, during fitting of the device to the mounting rail of the weapon, abuts against the trigger 7. The trigger 7 then pushes the locking rocker 13 outwards, and the surface 17*a* slides past the trigger 7. After the complete fitting of the device onto the mounting rail of the weapon, the portion of the locking rocker 13 protruding beyond the rear end 16 of the housing portion 10*b* tilts inwards again. Then, the locking rocker 13 is in the locking position. The tilting inwards may be effected by a spring member, which is assigned to the locking rocker 13.

In order to bring the locking rocker 13 into the release position, the portion not protruding beyond the rear end of the housing portion 10*b* only has to be pushed inwards. Then, the portion projecting beyond the rear end of the housing 10*b* is pivoted outwards about the pivot axis 14 such that the pin 17 no longer engages with the trigger 7. The device 1 may then be simply drawn from the weapon.

Compared to the embodiments shown in FIG. 7 and FIG. 8, the embodiment of the locking means 12 shown with reference to FIGS. 9A-C has the advantage that no portions of the locking means protruding laterally beyond the housing 10 are present, while the locking means 12 is in the locking position.

REFERENCE NUMERALS

1 device for arranging an accessory on a firearm
5 barrel of the weapon (including breechblock)
6 barrel bore
7 trigger
10 housing of the device 1
10*a* first portion of the housing 10
10*b* second portion of the housing 10
10*c* part of the first portion 10*a* projecting beyond the top side O2 of the second portion 10*b*
11*a* first fastening rail of the fastening means
11*b* second fastening rail of the fastening means
12 locking means of the fastening means
13 locking pin or locking rocker of the fastening means 12
14 rotation or pivot axis of the locking rocker 13
15 spring member of the locking means 12
16 rear end of the second portion 10*b* of the housing 10
17 pin
17*a* slanted surface of the pin 17
21 (first) opening for the laser sight
22 (second) opening for tactical light
23 (third) opening for imaging means 60
30 shot channel within housing 10 or in the first portion 10*a* of the housing 10
50 tactical light
60 imaging means, e.g., video camera/webcam
70 mounting rail at the underside U of the housing 10
80 energy storage, e.g., accumulators
90 cover plate at the front end wall VE
d1 distance between the center of the opening 21 and the board axis SA of the barrel 5
F compressive force (for releasing the locking means)
h1 height of the protruding part 10*c*
HE rear end wall of the first portion 10*a*
I inner profile
LA longitudinal axis of the device 1 or the housing 10
LA2 longitudinal axis of the locking rocker 13
OA (optical) censure axis of the laser sight
O1 top side of the first portion 10 eight
O2 top side of the second portion 10*be*
SA bore axis of the barrel 5
VA front end wall of the first portion 10*a*
U underside of the housing 10
α angle between the longitudinal axis LA2 and the slanted surface 17*a*

The invention claimed is:

1. A device (1) for arranging an accessory on a handgun, wherein the device comprises a housing (10) for receiving the accessory within the housing, wherein the housing (10) can be attached to the firearm, and wherein the housing (10) has a substantially L-shaped basic shape, the housing (10) has a first portion (10*a*) with a front end wall (VE) and with a rear end wall (HE) spaced apart from the front end wall (VE), wherein a substantially cuboid interior space is formed in the first portion (10*a*) of the housing (10), the housing (10) has a second portion (10*b*), which protrudes at the rear end wall (HE) of the first portion (10*a*) axially, wherein a substantially cuboid interior space is formed in the second portion (10*b*) of the housing (10), one leg of the L-shaped basic shape is formed by the first portion (10*a*) and the other leg of the L-shaped basic shape is formed by the second portion (10*b*), wherein the two portions (10*a*, 10*b*) are arranged substantially perpendicular with respect to each other, such that the two portions (10*a*, 10*b*) form an L-shaped interior space of the housing (10), and wherein the rear end wall (HE) of the first portion (10*a*) is substantially perpendicular to the top side (O2) of the second portion (10*b*), and the second portion (10*b*) has two fastening rails (11*a*; 11*b*) at the top side (O2) for fastening the housing (10) to the firearm.

2. The device of claim 1, wherein the second portion (10*b*) of the housing (10) extends in parallel to a longitudinal axis (LA) of the housing (10), and the two fastening rails (11*a*; 11*b*), extend spaced apart from each other and parallel to the longitudinal axis (LA) of the housing (10), wherein the inner profile (I) formed by the fastening rails (11*a*; 11*b*) and the top side (O2) of the second portion (10*b*) extending between the two fastening rails (11*a*; 11*b*) substantially corresponds to an outer profile of a mounting rail of the firearm, in order to be able to bring the second portion (10*b*) into engagement with the mounting rail, in order to fix the housing (10) to the firearm releasably.

3. The device of claim 2, wherein the inner profile (I) corresponds to an outer profile of a mounting rail provided at the underside of the barrel (5) of the firearm.

4. The device of claim 1, wherein the height (h1) of the part (10*c*) of the first portion (10*a*) protruding beyond the top side (O2) of the second portion (10*b*) is selected such that this part (10*c*), in the state of the housing (10) fixed to the firearm, at least partially is arranged axially in front of the barrel (5) of the firearm.

5. The device of claim 4, wherein the accessory comprises a light-emitting source which is arranged within the housing (10), wherein the front end wall (VE) of the first portion (10*a*) has a first opening (21) in the area of the protruding part (10*c*), through which a light beam of the light-emitting source can exit from the housing (10).

6. The device of claim 5, wherein the position of the first opening (21) in the front end wall (VE) is selected such that the opening (21), in the mounted state of the device, is located in front of the barrel (5) of the firearm, and that the distance (d1) between the center of the first opening (21) and the bore axis (SA) of the barrel (5) is smaller than 15 mm.

7. The device of claim 1, wherein the accessory comprises a tactical light (50), wherein the light source for the tactical light is arranged within the housing (10), and wherein the front end wall (VE) of the first portion (10*a*) has a second opening (22), through which the light of the light source for the tactical light can exit from the housing, or comprises a video camera or webcam arranged within the housing (10), and wherein the front end wall (VE) of the first portion (10*a*) has a third opening (23), through which the light from the outside can reach the optics of the imaging means, or comprises a communications interface being adapted to establish a communications connection to a mobile terminal or to a mobile network, or comprises a recording means, or comprises a GPS module, wherein an accumulator, is arranged within the second portion (10*b*) of the housing (10), which is coupled electrically to the accessory in order to supply the accessory with electrical energy.

8. The device of claim 7, wherein the energy storage can be charged inductively, or a connector is provided at the housing (10) in order to charge the energy storage by wire.

9. The device of claim 1, wherein a means is provided within or at the housing (10) for automatic activation of the accessory arranged within the housing, wherein the means for automatic activation comprises:

a switching means cooperating with a holster of the firearm such that upon pulling the firearm from the holster, the switching means can be activated, wherein the accessory is activated by the activated switching means, or a position sensor, which is adapted to activate or to deactivate the accessory depending on the position or orientation of the housing (10).

10. The device of claim 1, wherein the housing or the first portion (10*a*) and the second portion (10*b*) are formed in one piece.

11. The device of claim 1, wherein a locking means (12) is provided at the second portion (10*b*) of the housing (10) in order to lock the housing on the weapon.

12. The device of claim 11, wherein the locking means (12) comprises a locking rocker (13) being arranged pivotably about a pivot axis (14) at the second portion (10*b*) of the housing (10), and which can be brought from a locking position into a release position.

13. The device of claim 12, wherein the locking rocker (13) is aligned substantially in parallel to the longitudinal axis (LA) of the housing (10), and, in the state of the device (1) mounted on the weapon, can be brought into engagement with the trigger of the weapon in order to lock the device on the weapon.

14. The device of claim 11, wherein a spring member (15) is assigned to the locking means (12), the spring force of which retaining the locking means in the locking position, wherein the locking means can be brought into the release position against the spring force.

15. The device of claim 1, wherein the locking means (12) can be brought into engagement with recesses provided at the mounting rail of the weapon.

16. A handgun, with a device (1) according to claim 1 arranged thereon.

17. The handgun of claim 16, wherein the device (1) is fixed or can be fixed to a mounting rail arranged below a barrel (5) of the firearm.

* * * * *